US009409679B2

(12) United States Patent
Rumbough et al.

(10) Patent No.: US 9,409,679 B2
(45) Date of Patent: Aug. 9, 2016

(54) FOLDABLE CARRYING DEVICE

(71) Applicant: ADK PackWorks LLC, Vergennes, VT (US)

(72) Inventors: Douglas Rumbough, Cornwall, VT (US); Scott Hardy, New Haven, VT (US); Nathan Ayer, Weybridge, VT (US); Matthew Renna, Winooski, VT (US); Bernard Daoust, Sutton (CA)

(73) Assignee: ADK Packworks, Vergennes, VT (US)

( * ) Notice: Subject to any disclaimer, the term of this patent is extended or adjusted under 35 U.S.C. 154(b) by 0 days.

(21) Appl. No.: 14/133,570

(22) Filed: Dec. 18, 2013

(65) Prior Publication Data

US 2014/0177981 A1 Jun. 26, 2014

Related U.S. Application Data

(60) Provisional application No. 61/739,625, filed on Dec. 19, 2012, provisional application No. 61/847,065, filed on Jul. 16, 2013.

(51) Int. Cl.

| | |
|---|---|
| ***B65D 33/08*** | (2006.01) |
| ***B65D 37/00*** | (2006.01) |
| ***A45C 3/00*** | (2006.01) |
| ***A45C 3/04*** | (2006.01) |
| ***A45C 7/00*** | (2006.01) |
| ***A45C 7/02*** | (2006.01) |
| ***A45C 13/30*** | (2006.01) |
| ***A45F 3/04*** | (2006.01) |

(52) U.S. Cl.

CPC ..... *B65D 33/08* (2013.01); *A45C 3/001* (2013.01); *A45C 3/04* (2013.01); *A45C 7/0063* (2013.01); *A45C 7/0077* (2013.01); *A45C 7/02* (2013.01); *A45C 13/30* (2013.01); *A45F 3/04* (2013.01); *B65D 37/00* (2013.01)

(58) Field of Classification Search

CPC ..... B65D 33/007; B65D 33/02; B65D 33/30; B65D 33/1683; B65D 88/1612; B65D 88/1618; B65D 88/1681; B65D 33/08; B65D 37/00; A45C 3/001; A45C 3/02; A45C 3/04; A45C 7/0063; A45C 7/0077; A45C 13/30; A45F 3/04

USPC ..... 383/15–17, 33–35, 107, 119

See application file for complete search history.

(56) References Cited

U.S. PATENT DOCUMENTS

| | | | | |
|---|---|---|---|---|
| 1,691,904 | A * | 11/1928 | Gamble | 206/8 |
| 2,014,904 | A * | 9/1935 | Martin | 220/9.3 |
| 2,182,932 | A * | 12/1939 | Sanford | 220/9.3 |
| 2,375,819 | A * | 5/1945 | Reid | 108/115 |

(Continued)

*Primary Examiner* — Peter Helvey

(74) *Attorney, Agent, or Firm* — Green Mountain Innovations; Alan Coté

(57) ABSTRACT

A carrying device uses a folding structural frame covered by a shell. The frame is configured with two rigid members, which are joined together by two pivotable joints. A two-part base piece attaches to the frame and creates a structural bottom for the bag, with the base supporting articles placed inside of the bag. The frame and base create support that enables the bag to stand upright on a flat surface. The shell is made from a soft, flexible fabric material. The assembly is capable of folding to a substantially flat position, with the frame members moving relative to one another around the pivotable joints, and the base folding in half and becoming substantially co-planar with the frame. A strap attaches to the device in multiple configurations, allowing the device to be carried in different ways.

14 Claims, 13 Drawing Sheets

(56) References Cited

U.S. PATENT DOCUMENTS

| | | | | | |
|---|---|---|---|---|---|
| 2,390,673 | A | | 12/1945 | Wallace | |
| 2,517,757 | A | | 8/1950 | Adlerstein | |
| 2,543,243 | A | * | 2/1951 | Kliewer | 220/9.3 |
| 2,558,995 | A | * | 7/1951 | Tullis | 190/8 |
| 2,574,563 | A | * | 11/1951 | Hieb | 220/9.3 |
| 2,638,399 | A | * | 5/1953 | Seymour | 312/297 |
| 3,286,752 | A | * | 11/1966 | Duryee, Jr. | 220/9.3 |
| 3,633,932 | A | * | 1/1972 | Holden | 280/641 |
| 3,656,255 | A | * | 4/1972 | Rosenfeld | 446/125 |
| 3,659,816 | A | * | 5/1972 | Wilson | 248/97 |
| 3,722,905 | A | * | 3/1973 | Solomon | 280/39 |
| 3,733,017 | A | | 5/1973 | Pletz | |
| 3,806,146 | A | * | 4/1974 | Shaw | 280/7.12 |
| 4,003,455 | A | * | 1/1977 | Cortese | 190/8 |
| 4,074,839 | A | | 2/1978 | Wood | |
| 4,138,139 | A | * | 2/1979 | Alfonso | 280/652 |
| 4,588,154 | A | * | 5/1986 | Basore | 248/99 |
| 4,593,873 | A | * | 6/1986 | Nelson | 248/98 |
| 4,613,104 | A | * | 9/1986 | Garrott | 248/97 |
| 4,646,802 | A | * | 3/1987 | Basore et al. | 220/9.4 |
| 4,705,247 | A | * | 11/1987 | Delmerico | A47B 31/04 108/118 |
| 4,723,741 | A | * | 2/1988 | Doering | 248/97 |
| 4,759,518 | A | * | 7/1988 | Yardas | 248/97 |
| 4,815,784 | A | * | 3/1989 | Zheng | 296/97.7 |
| 4,825,892 | A | * | 5/1989 | Norman | 135/126 |
| 4,917,393 | A | * | 4/1990 | Rogers | 280/47.28 |
| 4,953,815 | A | * | 9/1990 | Beymer et al. | 248/97 |
| 4,964,650 | A | * | 10/1990 | Dickinson | B62B 3/02 280/47.34 |
| 5,069,573 | A | | 12/1991 | Blake | |
| 5,292,043 | A | | 3/1994 | McHale | |
| 5,390,839 | A | | 2/1995 | Peters | |
| 5,393,023 | A | * | 2/1995 | Callan | 248/97 |
| 5,429,437 | A | * | 7/1995 | Shaw et al. | 383/33 |
| 5,507,577 | A | * | 4/1996 | Fowler | 383/7 |
| 5,667,066 | A | * | 9/1997 | Simpson | 206/278 |
| 5,800,067 | A | * | 9/1998 | Easter | 383/104 |
| 5,890,640 | A | | 4/1999 | Thompson | |
| 5,927,581 | A | * | 7/1999 | Reddy et al. | 224/578 |
| 5,941,265 | A | * | 8/1999 | Zheng | 135/125 |
| 5,964,533 | A | * | 10/1999 | Ziglar | 383/36 |
| 5,975,101 | A | * | 11/1999 | Zheng | 135/125 |
| 6,092,544 | A | * | 7/2000 | Zheng | 135/125 |
| 6,334,593 | B2 | * | 1/2002 | Inoue | 248/95 |
| 6,419,193 | B1 | * | 7/2002 | Rodriquez | 248/98 |
| 6,499,498 | B1 | * | 12/2002 | Zheng | 135/125 |
| 6,517,444 | B1 | * | 2/2003 | Yoon | 473/197 |
| 6,536,641 | B1 | | 3/2003 | Sundara | |
| 6,783,016 | B2 | * | 8/2004 | Wang | 220/9.2 |
| 6,953,127 | B1 | * | 10/2005 | Esser | 220/9.3 |
| 7,080,653 | B2 | * | 7/2006 | Zheng | 135/126 |
| 7,160,028 | B1 | * | 1/2007 | Linday | 383/4 |
| D550,980 | S | * | 9/2007 | Dixon | D6/396 |
| 7,510,104 | B2 | | 3/2009 | Taylor | |
| 7,699,212 | B2 | * | 4/2010 | Turvey | B65D 1/225 206/508 |
| D619,316 | S | * | 7/2010 | Yang et al. | D32/37 |
| 7,815,372 | B2 | * | 10/2010 | Stanton et al. | 383/104 |
| 7,845,507 | B2 | * | 12/2010 | Kellogg et al. | 220/6 |
| 7,886,786 | B1 | * | 2/2011 | Christie | 150/108 |
| D677,940 | S | * | 3/2013 | Wang | D6/678.4 |
| D703,895 | S | * | 4/2014 | Wang | D32/37 |
| 8,807,337 | B2 | * | 8/2014 | Barcik | 206/315.8 |
| 2001/0017307 | A1 | | 8/2001 | Bentzen | |
| 2002/0023937 | A1 | | 2/2002 | O'Hare | |
| 2002/0170932 | A1 | | 11/2002 | Higgins | |
| 2005/0284866 | A1 | * | 12/2005 | Oakner et al. | 220/9.2 |
| 2006/0186119 | A1 | * | 8/2006 | Zheng | 220/9.2 |
| 2011/0174811 | A1 | * | 7/2011 | Sabounjian | 220/9.2 |

* cited by examiner

FOLDABLE CARRYING DEVICE

CROSS-REFERENCE TO RELATED APPLICATION

This application claims priority to U.S. Provisional Application 61/739,625, filed Dec. 19, 2012; and U.S. Provisional Application 61/847,065 filed Jul. 16, 2013

FEDERALLY-SPONSORED RESEARCH

None

BACKGROUND

1. Field

The design broadly relates to the field of carrying devices, particularly a device which is structured with a foldable internal frame and covered by a shell. Such devices may include bags for carrying articles such as groceries, and well as backpacks, bicycle panniers, and other related cargo-carrying implements.

2. Description of Related Art

Known in the art are numerous styles of bags for containing and carrying articles such as groceries. Such bags are typically constructed entirely from soft fabric materials such as nylon or canvas. Related devices for carrying grocery articles include pannier style bags for bicycles, whose construction typically includes a frame that supports a fabric shell, where either the frame or the shell can be attached to a rack mounted on a bicycle. The frame of the pannier bags may be foldable, so that it becomes substantially flat when not needed.

BRIEF SUMMARY

Described broadly herein is a carrying device, or bag, that uses a structural frame covered by a shell. The shell is preferably made from a soft, flexible fabric material. The frame is configured with two rigid members, which are joined together by two pivotable joints. In the preferred embodiment, a two-piece base piece creates a structural bottom for the bag, with the base supporting articles placed inside of the bag. The two-piece base is formed from left and right base pieces, with a pivotable joint connecting the right and left pieces together along one edge of each side. The edge opposite of the pivotable joint on each base piece is pivotably joined to one of the frame members. The frame and base create support that enables the bag to stand upright on a flat surface. An opening in the shell facilitates easy access to the interior of the device. The assembly is capable of folding to a substantially flat position, with the frame members moving relative to one another around the pivotable joints, and the base folding in half and becoming substantially co-planar with the frame.

DETAILED DESCRIPTION

Figure 1:
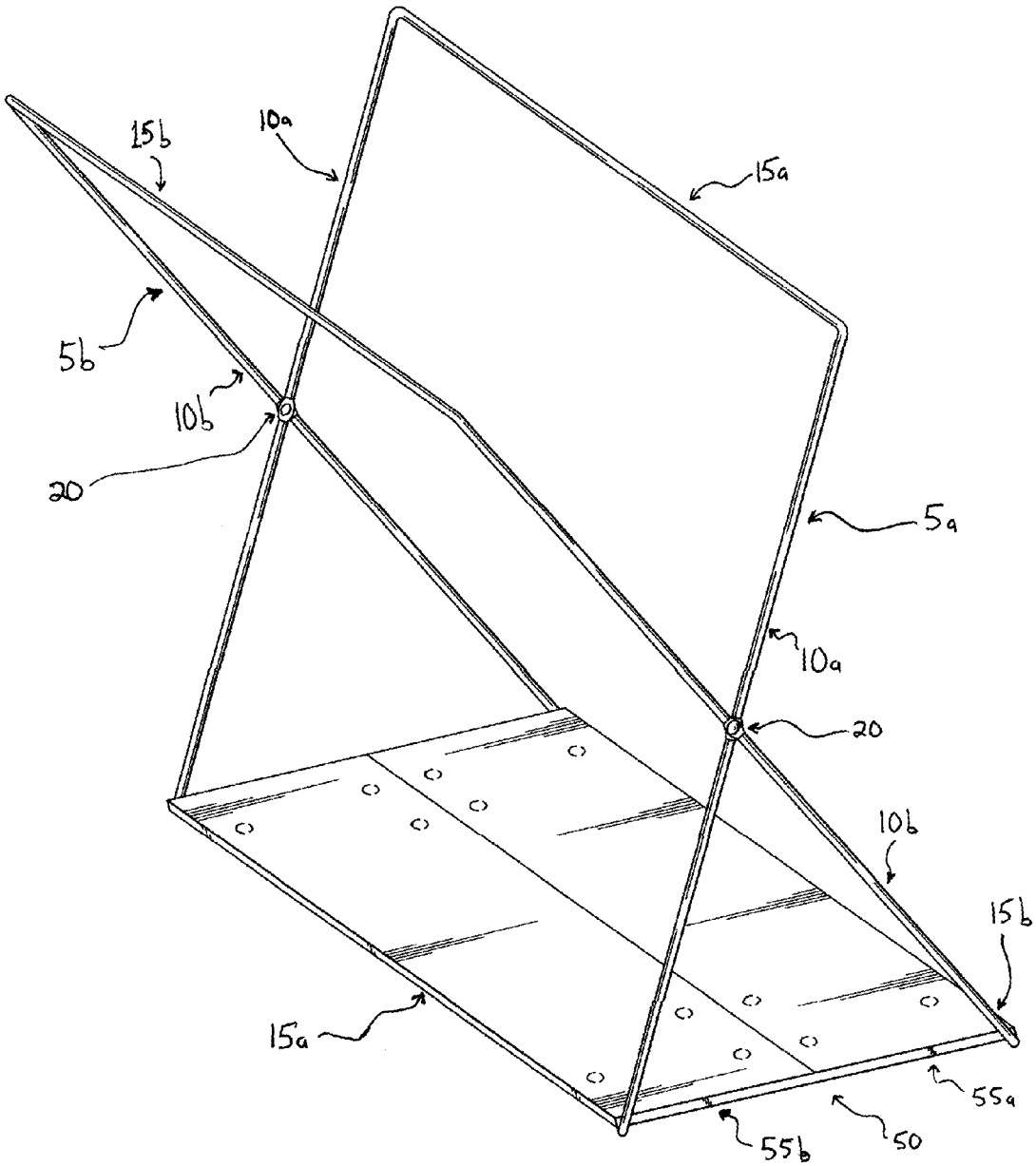
FIG. 1 is a front perspective view of the device
Figure 2:
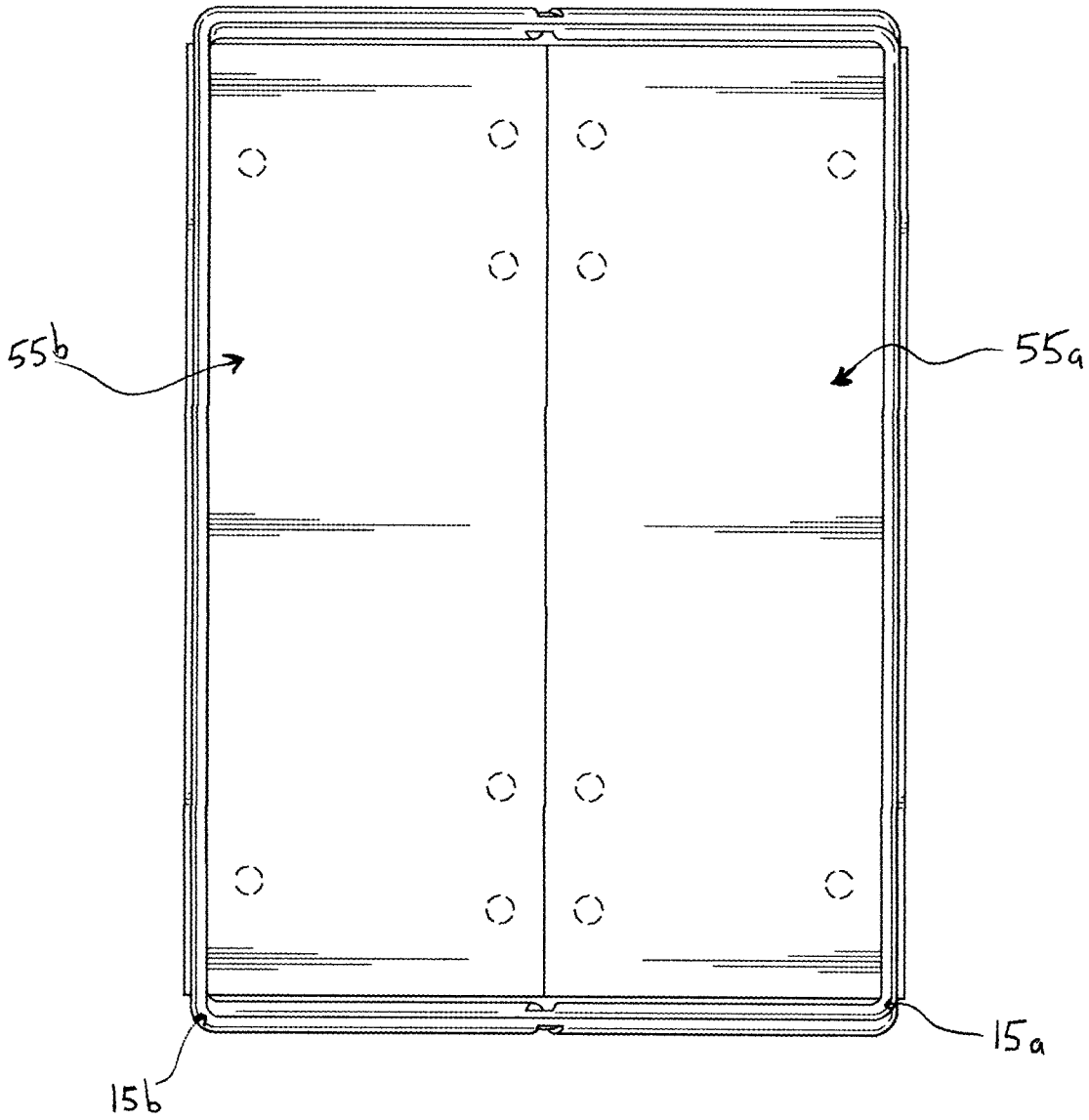
FIG. 2 is a top view thereof.
Figure 3:
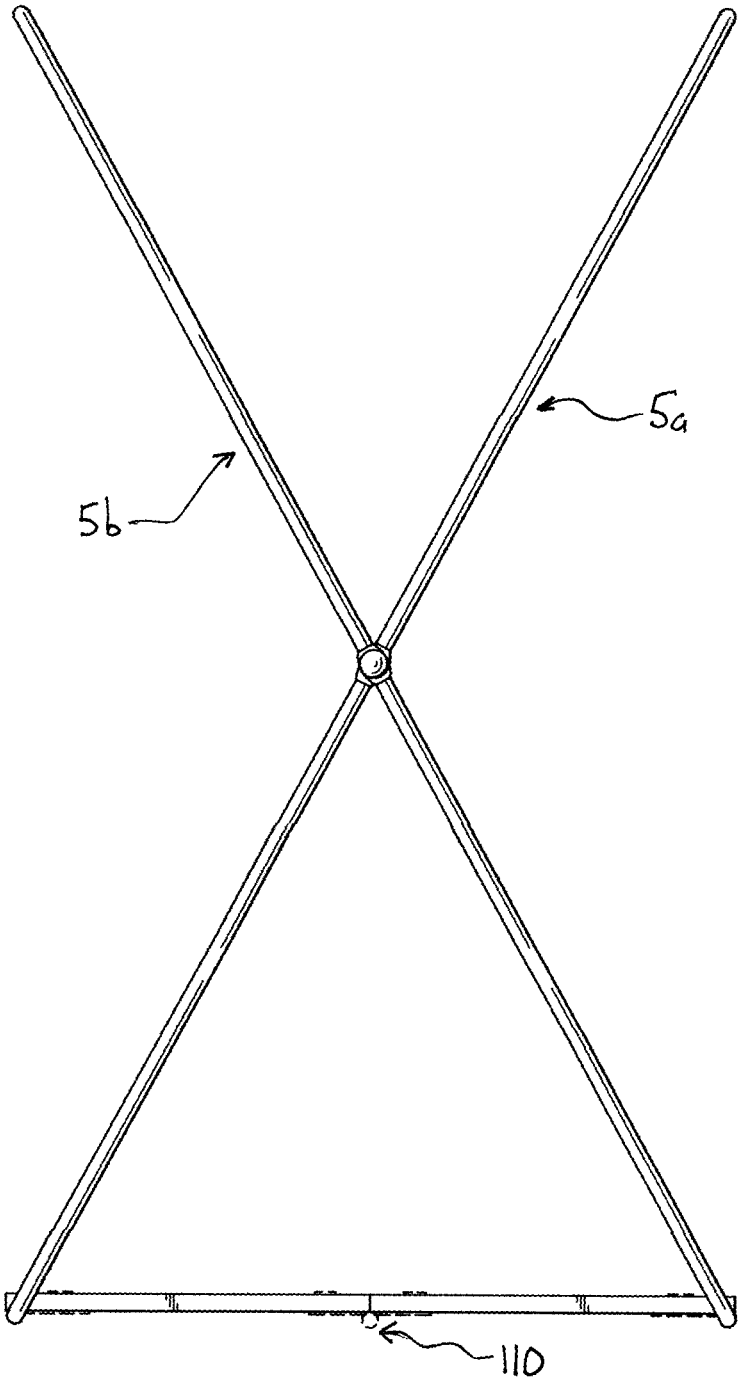
FIG. 3 is a right end view thereof.
Figure 4:
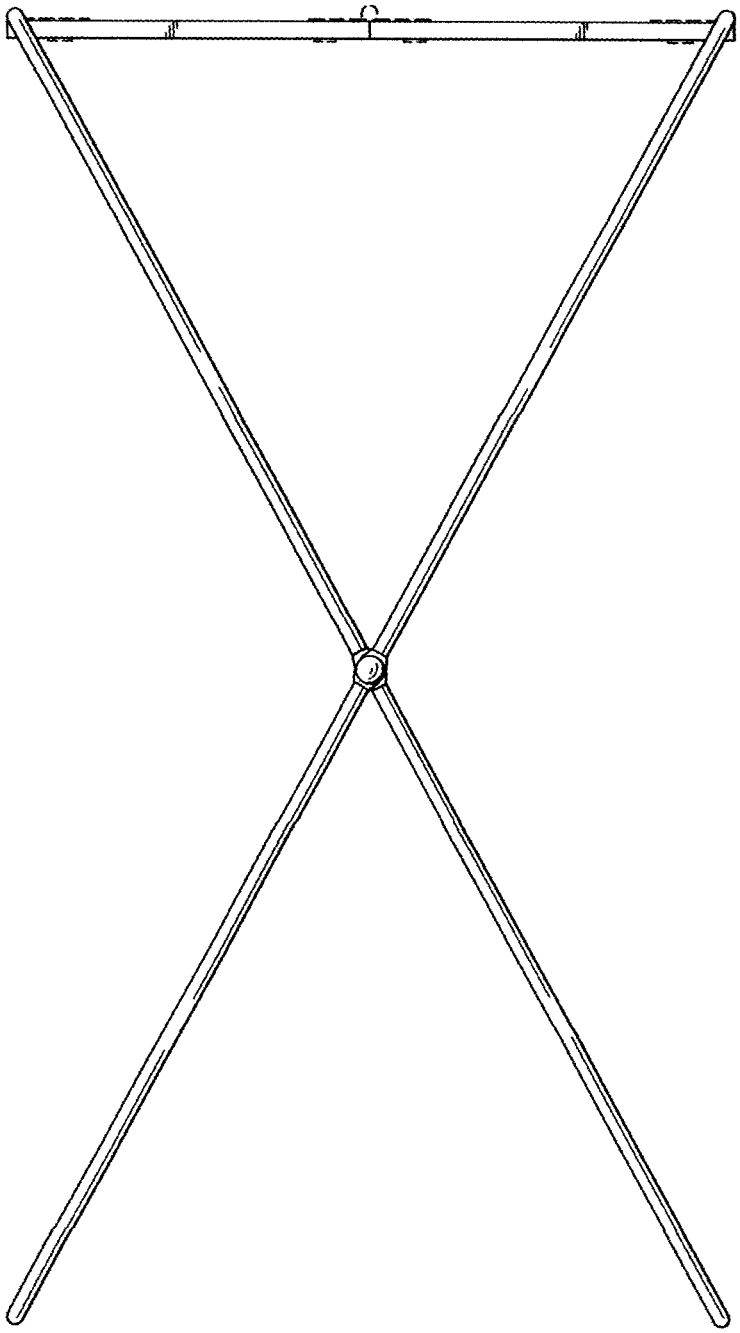
FIG. 4 is a left end view thereof.
Figure 5:
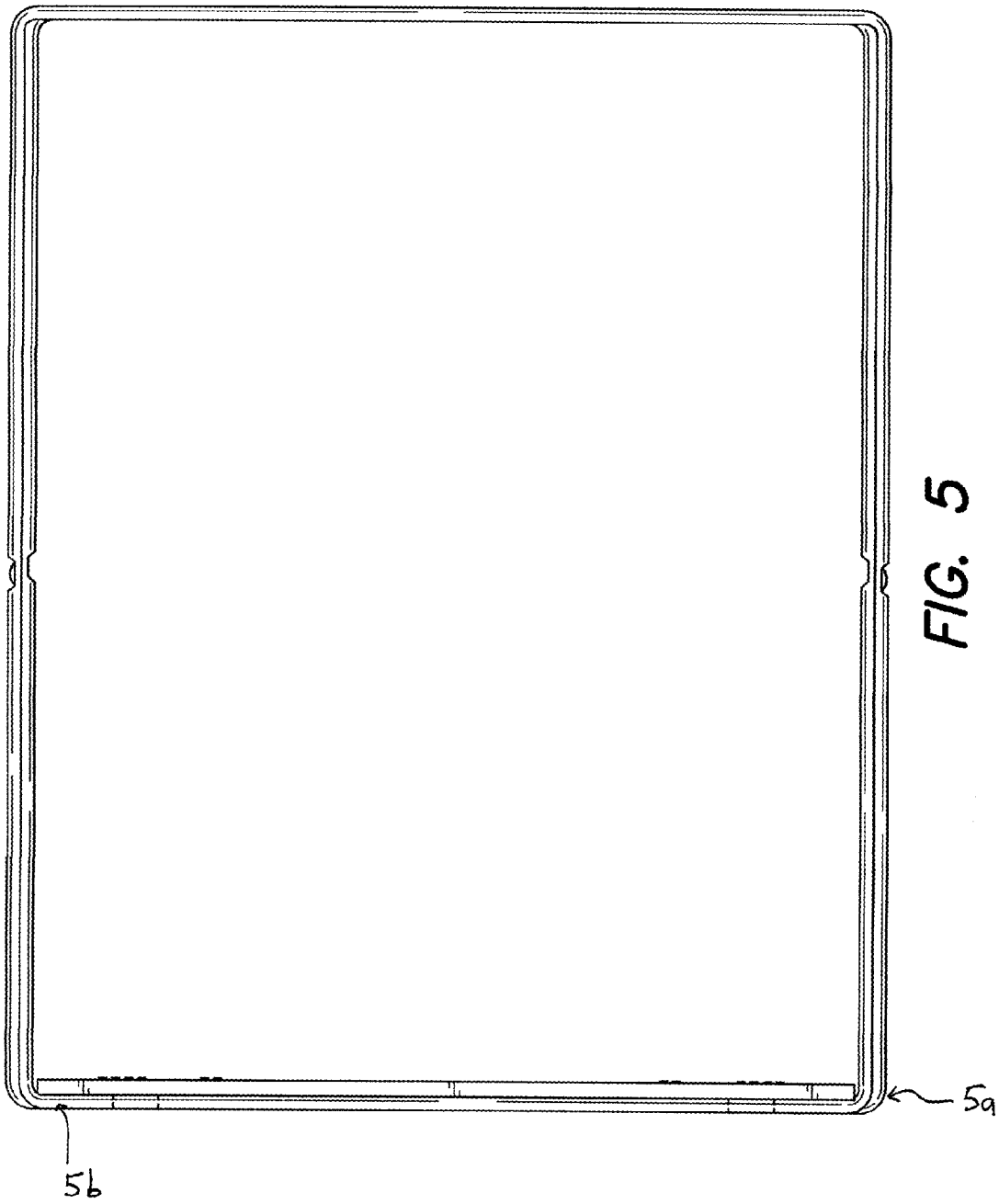
FIG. 5 is a front elevation view thereof.
Figure 6:
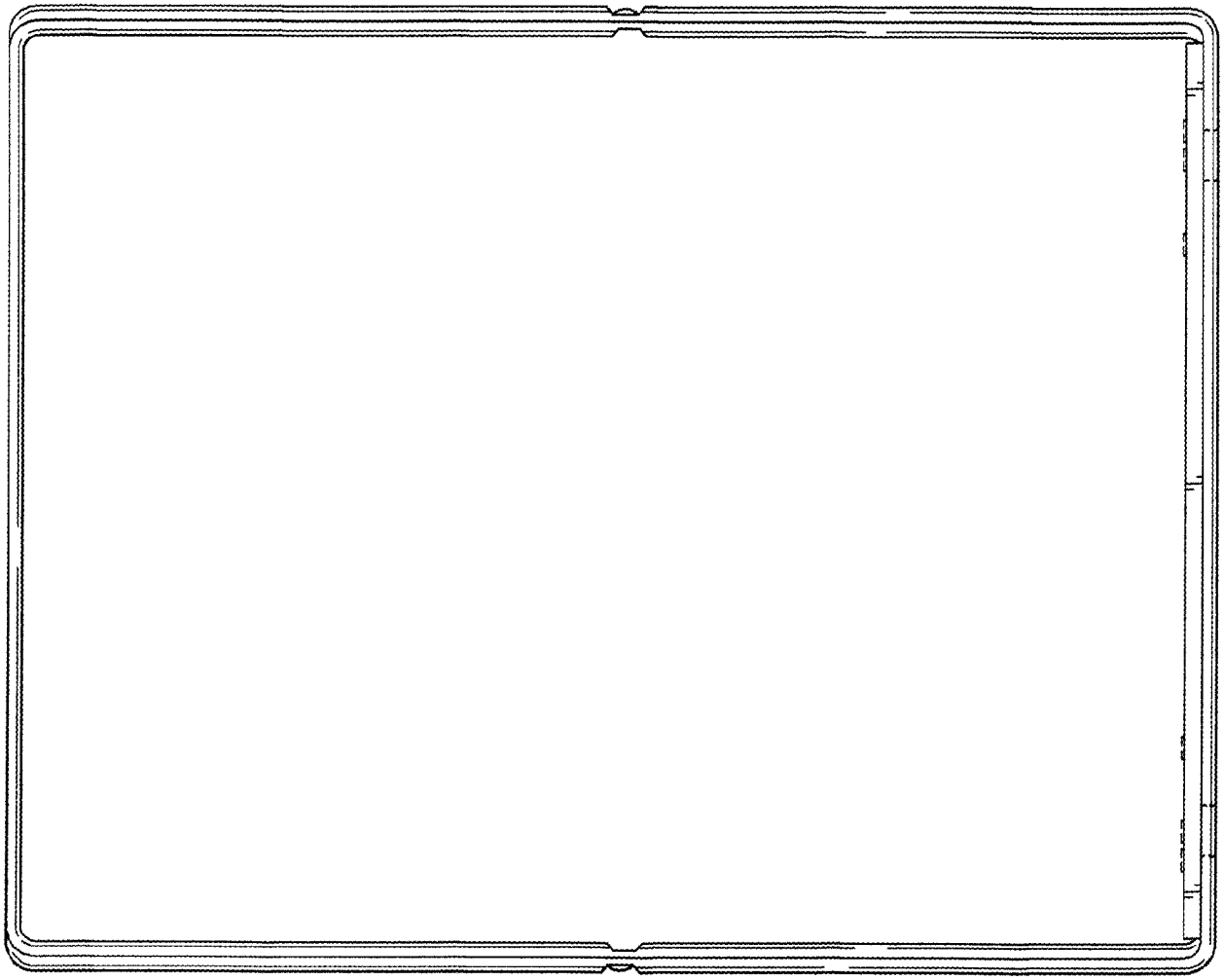
FIG. 6 is a rear elevation view thereof.

FIG. 1 shows the overall frame and base of an embodiment of the carrying device, or bag. Here it is shown in its open, or unfolded position The frame is constructed with first frame member 5*a* and second frame member 5*b*. These frame members are quadrilaterally shaped. The frame members shown in the FIG. 1 are substantially rectangular in shape, however other quadrilateral shapes such as trapezoidal may be used, in which the upper and lower horizontal frame sections may be parallel. Other four sided shapes using different proportions and angles may be used as well. Each frame member includes vertical sections and horizontal sections. Here, left vertical sections are 10*b*, right vertical sections are 10*a*, right horizontal sections are 15*a*, left horizontal sections are 15*b*.

Frame members 5*a* and 5*b* are pivotably joined together by pivots 20, with one pivot joining the right and left vertical sections as shown. The pivoting mechanism is a single axis mechanism such as a rivet, bolt, etc. Pivots 20 are located at approximately a midpoint of each vertical section, where the midpoint is considered to be in the middle one-third of the total length of 5*a* or 5*b*

FIG. 1 also shows two-piece base 50, which is made from right base 55*a* and left base 55*b*. Further detail of the bases pieces is shown as part of FIG. 10, described below.

Other views of the same embodiment of the bag's frame as in FIG. 1 are shown in FIGS. 2 through 6.

Figure 7:
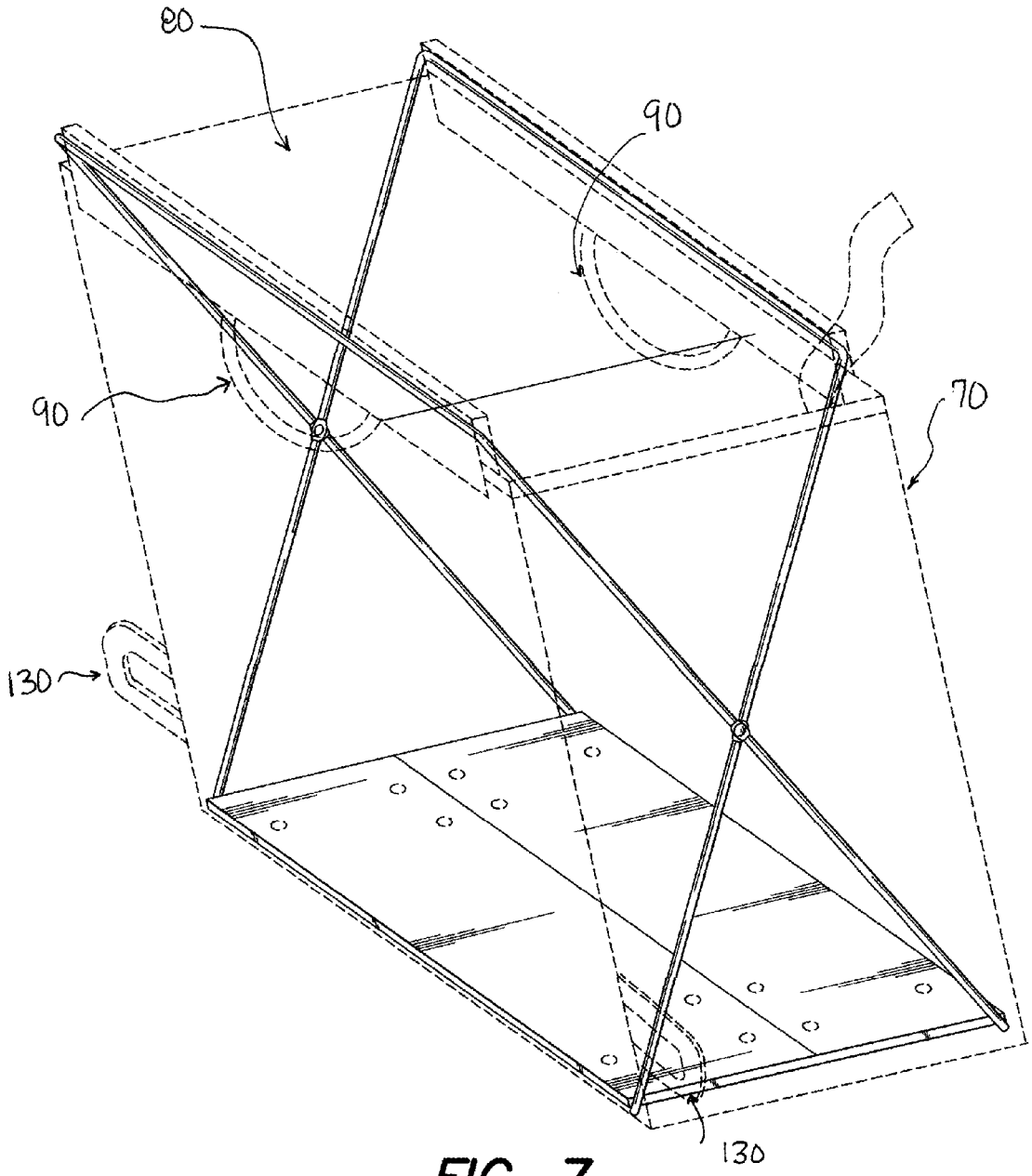
FIG. 7 is a front perspective view thereof, with the broken line showing the flexible shell.

FIG. 7 shows a flexible shell 70 installed that surround a frame assembly. The shell may surround the frame and the base, or the frame only. In the first case, the shell covers the frame and the bottom of the base piece (not shown), while in the latter case, the shell has four sides and terminates at the edge of the base pieces. In the preferred embodiment, the shell may be fabric, constructed from flexible, natural, man-made or synthetic materials such as nylon, Tyvek, canvas, and other materials known by those skilled in the art. The shell may be made from a single piece of material or multiple pieces joined together. Alternatively, the shell may be made from a hard material such as metal, wood, plastic, carbon, or other suitable materials known by those skilled in the art. An optional top cover, not shown, may be part of the shell. The cover provides additional security for the contents of the bag, and folds backward to create a top opening to allow full access to the interior cavity of the bag. Shell 70 is preferably removable from the frame members, with means such as hook-and-pile strips that fold over the top horizontal frame members, snaps, and other means known in the art.

Figure 13:
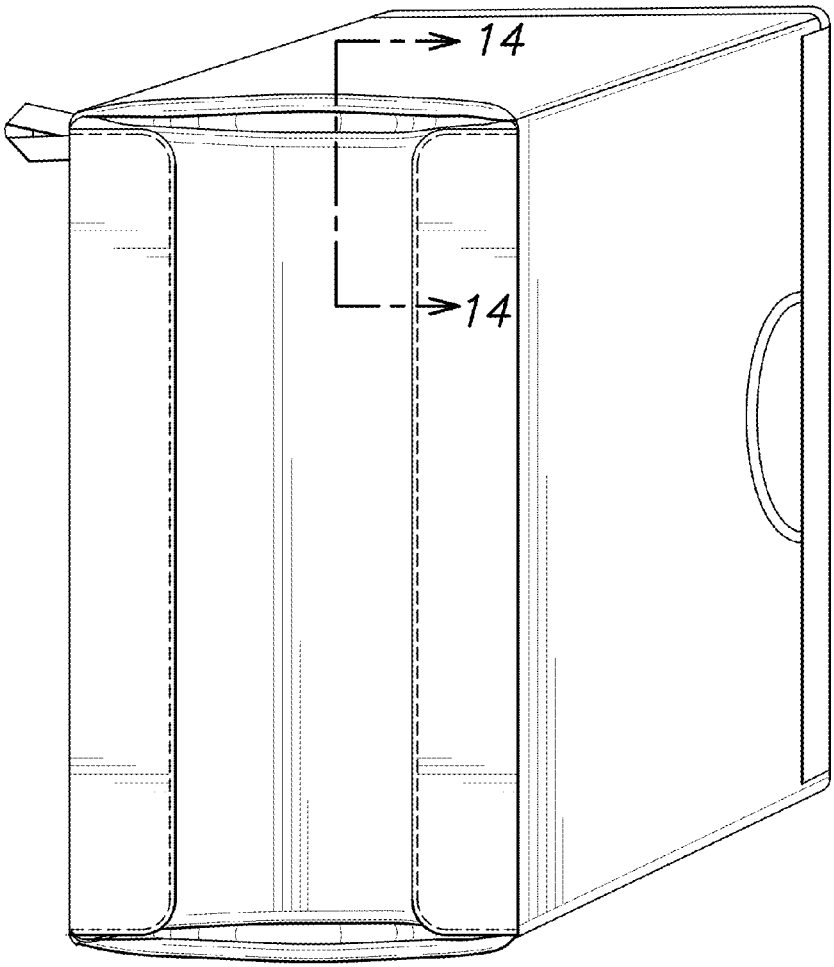
FIG. 13 is a bottom perspective view of the device in its expanded position.
Figure 14:
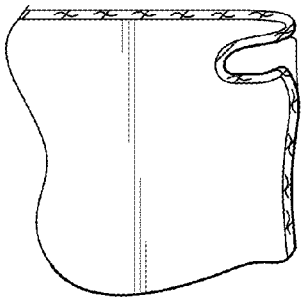
FIG. 14 is an expanded view of cross section at 4 in FIG. 13, showing the fabric gusset.

FIGS. 11 through 14 show further detail of the device. FIGS. 13 and 14 show cross section 4, where the shell material includes a pleat along each of the device's shorter bottom edges. FIG. 14 shows a cross section of the shell material when the bag is in its expanded position. When the overall device is folded, the material of the pleat becomes repositioned, with a majority of the pleat unfolding, thereby creating enough slack material to allow the shell to fold with the frame.

Preferably, the frame assembly is positioned inside of the shell. However, alternate versions (not shown) may also be used in which the frame is positioned outside of the shell, or a hybrid in which some portions of the frame are exterior of the shell, and some are interior of the shell. Additionally, an inside liner (not shown) may be used with the shell.

The top access opening created by the combination of fabric and frame members creates a rigid opening to the device's interior cavity, and thus easy access to the interior of the bag. A conventional grocery or tote bag has a floppy opening, as there's no rigid structure to support the opening. Similarly, a conventional bag lacks any structure to make the bag stand upright on its own. Thus two hands are required to access the interior of a conventional bag: one hand to hold the bag upright and expose the opening into the interior cavity, and another hand to reach into the bag's interior to place or retrieve items. In the present invention, the frame-supported opening does not require one hand to brace the material around opening, or to hold the bag upright.

Shell 70 may optionally include additional features, such as pockets both inside and/or outside for enhanced organization. There may be a multitude of compartments or dividers within the unit providing options for organization. There also may be options such as an insulated fabric shell to help keep the bag contents cool or warm.

Other features such as carrying handles 90 are included on the preferred embodiment. Here, the handles are formed as cut-outs in shell 70, forming handles underneath with a top edge spanned by right horizontal sections 15*a* and left horizontal section 15*b*. Of course, other strap configurations may be used as well. Hooks or straps that allow the bag to be hung easily can also be included. In addition, there can be D rings, elastic cording and the like attached to the shell for expanded functions and attachments. In the preferred embodiment, the bag is carried by hand. Optionally, the bag may be carried as a backpack. For use as a backpack, there is at least one strap, and preferably two, anchored to the frame members or to the shell. Optionally, the bag may have a single longer shoulder strap. These strap configurations are further detailed in FIG. 11.

Figure 8:
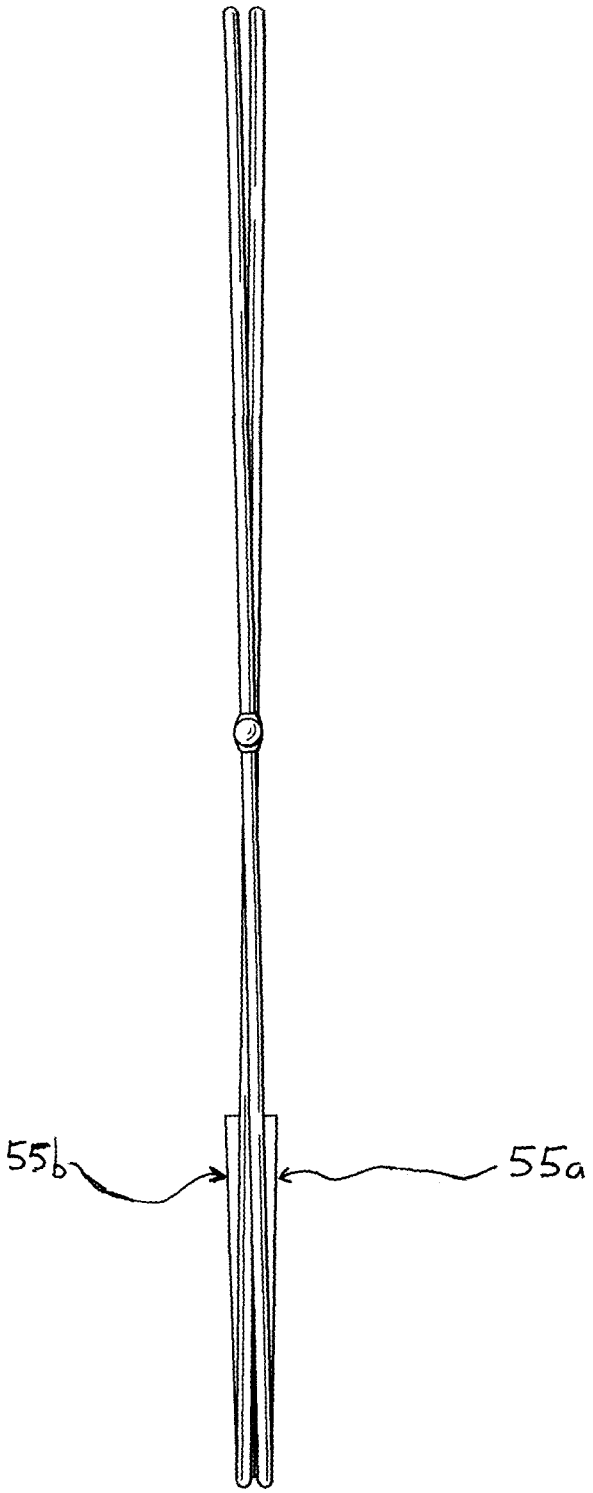
FIG. 8 is a right end view of the frame in its folded position.

FIG. 8 shows the frame in its folded, or closed position, which is substantially flat. While shell 70 remains in place and folded with the frame in use, the shell is not shown here in order to better show details of the folded frame. When in the closed position, as shown, first and second frame members move around pivots 20, and the vertical sections of the frame members become positioned substantially parallel to one another, creating a overall device that is substantially flat.

FIG. 8 also shows the right base 55*a* and left base 55*b* folded around hinge 110 (seen in FIG. 10), allowing the base piece to fold upwards in half and become coplanar with the first and second frame members.

The frame assembly may be made from materials such as steel, aluminum, fiberglass, carbon, wood, and various other metals and plastics and composites known by those skilled in the art. Similarly, a variety of frame material cross-sections may be used, such as circular, oval, square, rectangular, or various I-Beam types; any of these cross sections may be hollow/tubular, or solid. The frame material may be flattened-out in the area of the pivots, in order to facilitate the rivet or similar fastener that is used to pivotably join the first and second frame members together. Optionally, a different style pivot joint may be used, with the first frame member may be fabricated to allow the second frame member to pass through the first member at the pivot The outside of the bottom of the unit may include features such as bumpers, to protect the shell or frame from wear, though these bumpers are not shown in the FIGS. The bumpers may be made from natural or synthetic materials.

Figure 9:
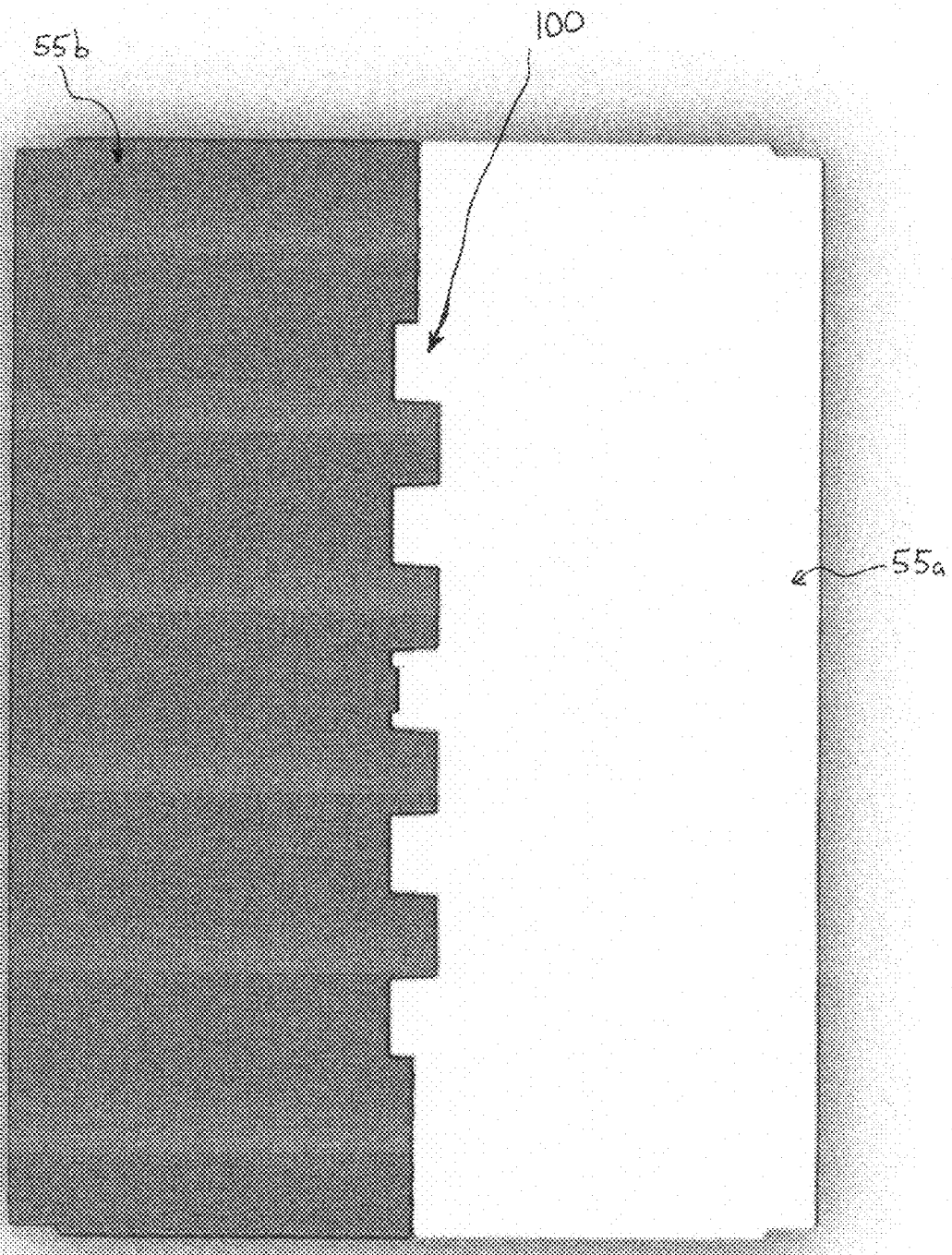
FIG. 9 is a top view of the base of the device.

FIG. 9 shows base piece 50, which is made from right base 55*a* and left base 55*b*. Interlocking ridges 100 are seen in this view.

Figure 10:
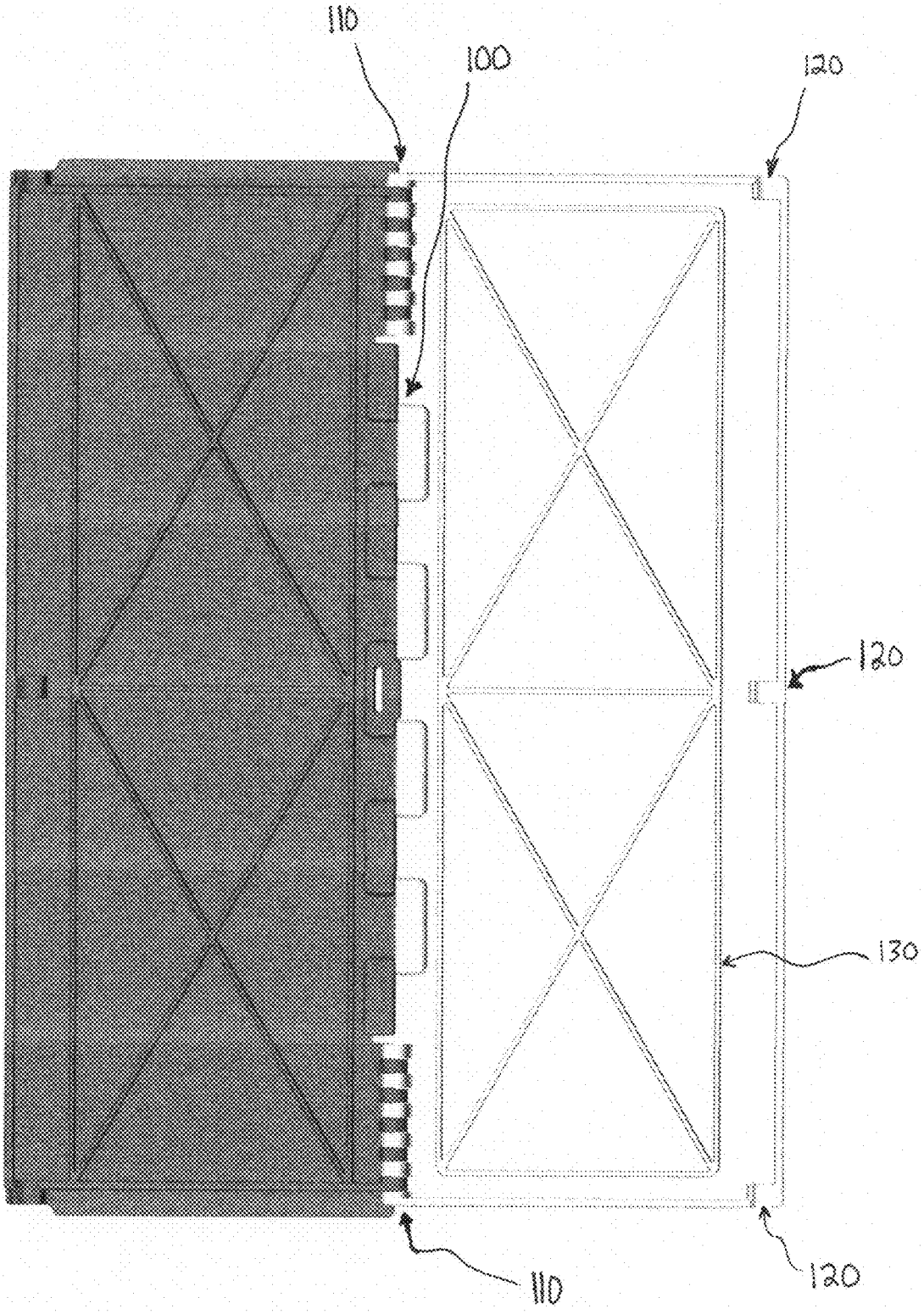
FIG. 10 is a bottom view of the base of the device.
Figure 12:
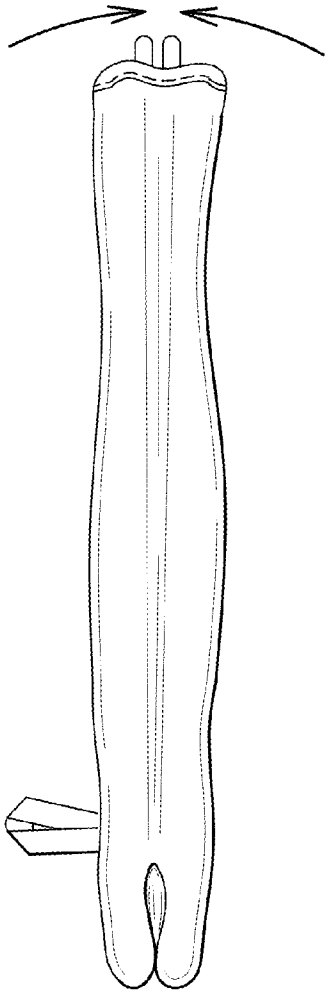
FIG. 12 is a left side view of the device in its folded position.
Figure 11:
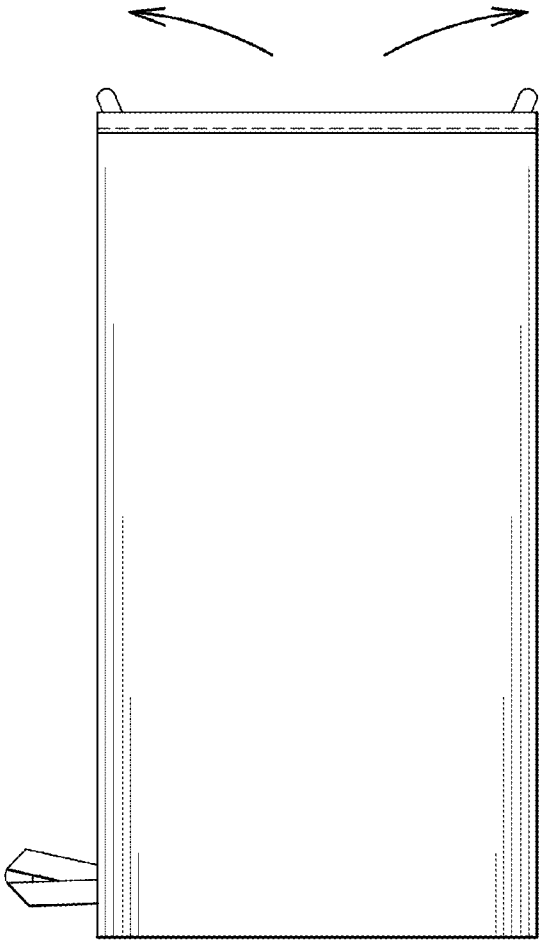
FIG. 11 is a left side view of the device in its expanded position.

FIG. 10 also shows base piece 50, including interlocking ridges 100 engage right and left base pieces together, along with base hinges 110. Ridges 110 form an interlocking system of small plates, or tabs, in which a tab from one side slides underneath the edge of the opposing base piece. This configuration allows the base pieces to lock together, providing a rigid planar structure when contents are loaded into the bag, while also allowing the right and left plate to pivot using hinges 110. As shown, hinge 110 is a finger-joint, or piano, type, with a cylindrical hinge pin used as a hinge axis.

Alternate embodiments of the base use a finger joint hinge along the entire edge length of the right and left base pieces, and omit ridges 110. Another embodiment uses conventional hinges that are mounted to the base plate with fasteners, or through molding or bonding. However, the interlocking ridges offer advantages in manufacturing and assembly, and, depending on material selection, may provide additional strength and stiffness. In addition, structural ribs 130 are shown in FIG. 10, which add stiffness and strength the base pieces. Note that in FIGS. 1-8, the interlocking ridges are not shown as part of the base plate.

FIG. 10 also shows engagement points 120, which connect the right and left base pieces to the first frame member 5*a* and second frame member 5*b*. As shown, the engagement points are formed as partial circles that snap around the first and second frame members, and allow the base pieces to rotated around the frame members. Alternately (not shown), the base pieces may include holes to lighten the pieces and reduce material cost—such a structure being analogous that of a plastic milk crate.

FIG. TK shows an alternate one-piece base, which is pivotably joined on one edge to a lower horizontal section of said first frame member, with an opposing edge that engages a lower horizontal edge of said second frame member. The engagement may include a fastener that removably snaps around the frame member, or the one-piece may simply rest on the base member, or other suitable engagement means may be used. The one-piece base may further include a live hinge spanning the midsection of said one-piece-base, allowing said one-piece base to fold lengthwise.

Figure 15:
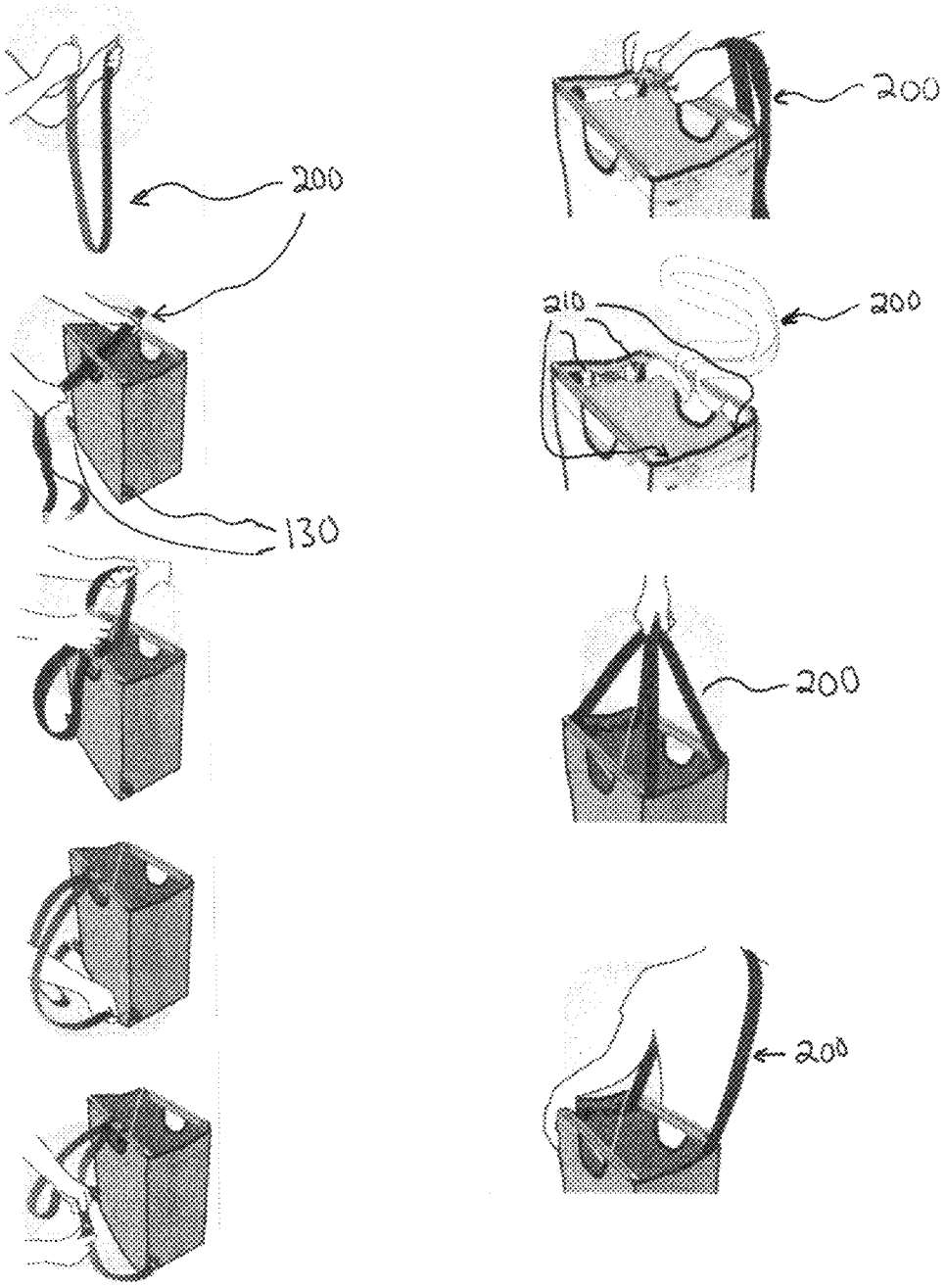
FIG. 15 is a compilation of multiple steps showing a strap attached to the bag in different ways.

FIG. 15 is a compilation of multiple illustrations showing an embodiment of the invention that includes one or more carrying straps. The straps may be configured in numerous ways, including as a backpack, tote-style strap, or a single shoulder strap for over-the-shoulder use. Included on the shell 70 are first and second loops, each loop located at a bottom corner of shell 70, and a plurality of guides located inside shell 70. The loops may be in the form of a fabric, webbing, d-rings, or other suitable types. The strap with a first attachment mechanism on one strap end and a second attachment mechanism on the strap's opposing end, so that the ends may be fastened together. The attachment mechanism may be a releasable latch, or other suitable type.

To form two backpack straps, a strap 200, as shown in the left column of FIG. 15, may be foldably fastened to handle 90, by first folding strap 200 in half, feeding through the handle 90 of the bag, and attaching each end to loops 130 (which are also shown in FIG. 7). Here, the attachment mechanism shown is a snap hook type, also known as bolt snap hook, as commonly used on dog leashes. Of course, other types of attachment mechanisms may be used, such as squeeze-and-release, or fastex, buckles, and many other types. Sliding-type buckles on the strap allow the user to adjust the straps to desired length. In this configuration, the single strap quickly and easily becomes a backpack strap.

The right column of FIG. 15 shows another configuration allows strap 200 to form a tote-style carrying strap. Here, as shown, one end of the strap is threaded through the four guides 210 between the frame and shell 70. The ends of the strap 200 are then connected together, using the buckles as described above. This creates a strap arrangement from four points of the bag. Alternately, the strap may be slid to create a single shoulder strap for over-the-shoulder use as shown.

Although the description includes one or more embodiments, it will be understood that other versions may be made without departing from the spirit and scope of the present embodiments. Hence, the invention is deemed limited only by the claims and the reasonable interpretation thereof.

What is claimed:

1. A carrying device, comprising an assembly of:

a first frame member and a second frame member, each said frame member quadrilaterally shaped, with the two said frame members pivotably joined together at approximately a midpoint of each of their vertical sections;

a flexible shell that surrounds said assembly, said shell including at least one access opening, said flexible shell including pleats on at least one bottom edge of said shell, with a majority of said pleats unfolding and creating slack material to allow said shell to fold with said frame members when said frame members are folded to a substantially flat position;

a two-piece base formed from a right base and a left base, with said right and left bases pivotably joined together along one joined edge of each, said right and left bases pivotably joined to said lower horizontal sections of said first and second frame members;

said edges joining said right base and left base together including interlocking ridges, said ridges formed by at least three pairs of tabs.

2. The device of claim 1, in which said right base and said left base include diagonal structural ribs.

3. The device of claim 1, in which said frame members pivot and said right base and said left base fold along said joined edge such the device can fold to a substantially flat position.

4. The device of claim 1, in which said frame members are positioned inside said flexible shell.

5. The device of claim 1, in which said shell includes at least one cutout to form a carrying handle, with a top edge of said cutout spanned by a horizontal frame member.

6. The device of claim 1 in which horizontal sections of each said frame member form a rigid opening to the device's interior cavity.

7. The device of claim 1, in which said shell is removable from said first and second frame members.

8. A carrying device, comprising:

a first frame member and a second frame member, each said frame member each said frame member quadrilaterally shaped, with the two said frame members pivotably joined together at approximately a midpoint of each of their vertical sections;

a flexible shell that envelopes said assembly, said shell including an access opening, first and second loops, each said loop located at a bottom corner of said shell, and a plurality of guides located inside said shell;

said flexible shell including pleats on at least one bottom edge of said shell, with a majority of said pleats unfolding and creating slack material to allow said shell to fold with said frame members when said frame members are folded to a substantially flat position;

a strap with a first attachment mechanism on one strap end and a second attachment mechanism on said strap's opposing end;

a two-piece base formed from a right base and a left base, with said right and left bases pivotably joined together along one joined edge of each, said right and left bases pivotably joined to said lower horizontal sections of said first and second frame members;

said edges joining said right base and left base together including interlocking ridges, said ridges formed by at least three pairs of tabs.

9. The device of claim 8, in which said frame members pivot and said right base and said left base fold along their joined edge such the device can fold to a substantially flat position.

10. The device of claim 8, in which said first attachment mechanism attaches to said first loop, said second attachment mechanism attaches to said second loop, and a midpoint of said strap is foldably fastened to a carrying handle on said device, to form two backpack straps.

11. The device of claim 8, in which said strap passes through each said guide, and first and second attachment mechanisms are then attached to each other to form a shoulder strap.

12. The device of claim 8, in which said strap passes through each said guide, first and second attachment mechanisms are then attached to each other to form tote-style straps.

13. A carrying device, comprising an assembly of:

a first frame member and a second frame member, each said frame member quadrilaterally shaped, with the two said frame members pivotably joined together at approximately a midpoint of each of their vertical sections;

a flexible shell that surrounds said assembly, said shell including at least one access opening, said flexible shell including pleats on at least one bottom edge of said shell, with a majority of said pleats unfolding and creating slack material to allow said shell to fold with said frame members when said frame members are folded to a substantially flat position;

a rigid one-piece base pivotably joined on one edge to a lower horizontal section of said first frame member, with an opposing edge that removably engages a lower horizontal edge of said second frame member.

14. The device of claim 13, in which said rigid one-piece base further includes a live hinge spanning the midsection of said one-piece-base, allowing said one-piece base to fold lengthwise.

* * * * *